United States Patent [19]

Fitzgerald et al.

[11] Patent Number: 4,795,373

[45] Date of Patent: Jan. 3, 1989

[54] LAMP WITH PLASTIC BASE

[75] Inventors: James J. Fitzgerald, Boonton; Nickolas P. Demas, Cranford, both of N.J.

[73] Assignee: Cooper Industries, Inc., Houston, Tex.

[21] Appl. No.: 50,180

[22] Filed: May 15, 1987

[51] Int. Cl.[4] ..... H01R 17/00

[52] U.S. Cl. ..... 439/619; 439/544; 439/699

[58] Field of Search ..... 439/168, 182, 220, 280, 439/336, 356, 360, 414, 375, 419, 541, 558, 602, 605, 614, 615, 661–667, 702–707, 617, 619, 660, 345, 691, 874, 544, 699; 313/318

[56] References Cited

U.S. PATENT DOCUMENTS

| | | | |
|---|---|---|---|
| 2,984,813 | 5/1961 | Bossi | 439/619 |
| 3,253,249 | 5/1966 | Hess et al. | 439/660 |
| 3,256,508 | 6/1966 | Malm | 439/619 |
| 3,892,463 | 7/1975 | Horan | 439/619 |
| 3,986,068 | 10/1971 | Albrecht | 439/619 |
| 4,181,390 | 1/1980 | Aizawa | 439/375 |
| 4,573,754 | 3/1986 | Hill | 439/660 |

*Primary Examiner*—David Pirlot

*Attorney, Agent, or Firm*—Eddie E. Scott; Alan R. Thiele

[57] ABSTRACT

A mounting arrangement for use with a baseless electrical lamp includes an insulating fixture having a plurality of electrically conductive terminal members. The exposed lead wires which protrude from the press of the baseless electrical lamp engage the electrically conductive terminal members so as to both provide electrical current to the baseless electrical lamp and retain the baseless electrical lamp in the insulating fixture.

3 Claims, 1 Drawing Sheet

Fig. 1
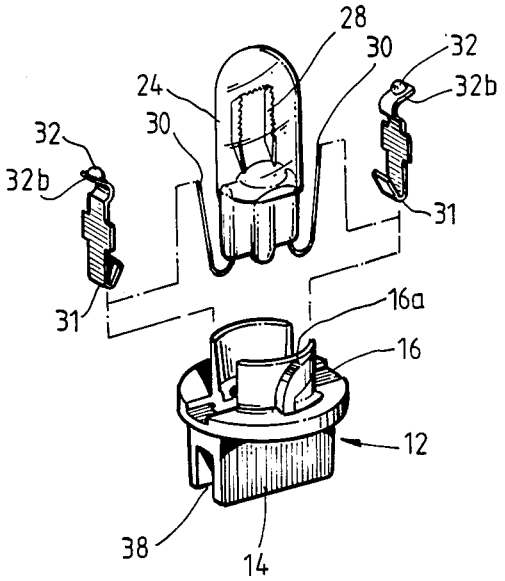
Fig. 2
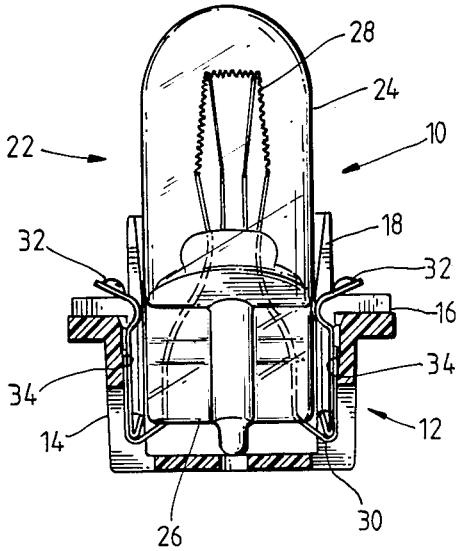
Fig. 3
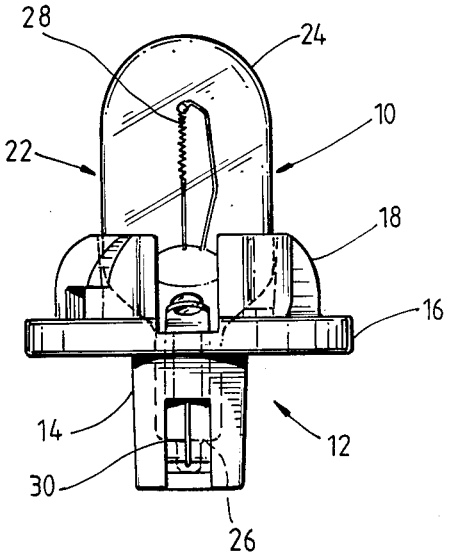
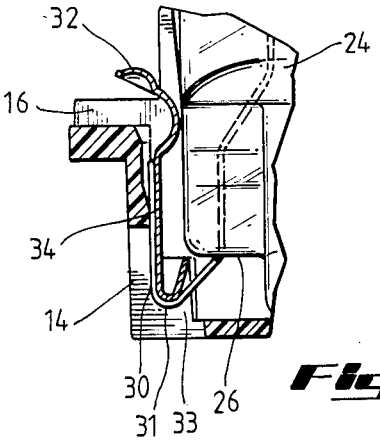
Fig. 4

LAMP WITH PLASTIC BASE

BACKGROUND OF THE INVENTION

The present invention pertains to electric lamps, more particularly the present invention pertains to baseless electric lamps typically used in automotive applications.

In order to reduce the expense of electric lamps, it has been discovered that baseless electric lamps may be used. Such lamps do not have a metallic base for engagement with a lamp socket rather the lead wires from the lamp filament extend through the press or bottom sealed portion of the lamp. Electric current supplied to the exposed lead wires causes the filament to glow. Methods of mounting such baseless lamps are shown in U.S. Pat. No. 4,647,132 to Mikola and U.S. Pat. No. 4,653,841 to Plyler et al.

When baseless electric lamps are fit within adapters for connection to power sockets they may not be properly seated within the adapters for electrical contact or if electrical contact is made, such contact may come undone through the effects of vibration. There is therefore a need in the art to provide a means for mounting baseless electric lamps in adapters for receipt in power receptacles in automobiles such that the lamp may be securely held in place even in severe vibratory conditions, to maintain a continuous flow of electric current to the lamp.

SUMMARY OF THE INVENTION

A non-conductive mounting fixture or adapter for use with a baseless electrical lamp, which lamp has a bulbous portion, a press and exposed lead wires, includes an elongated lower portion, a central flange portion and an upper wall portion. The elongated lower portion of the mounting fixture surrounds the prese of the baseless electric lamp. The mounting fixture also includes a plurality of electrically conductive terminal members which protrude therefrom. The baseless electrical lamp is both retained in the mounting fixture and furnished with activating electrical current by interengagement of the exposed lead wires protruding from the press of the baseless electrical lamp in the space between the electrically conductive terminal members and the inside wall of the insulating mounting fixture. This connection is made by frictional engagement of the exposed lead wires with the electrically conductive terminal members and/or by welding or soldering the exposed lead wires to the electrically conductive terminal members. Once the baseless lamp is affixed to the mounting fixture it may be placed in a power receptacle in an automobile.

BRIEF DESCRIPTION OF THE DRAWINGS

A better understanding of the baseless lamp and mounting fixture combination of the present invention may be had by reference to the drawings wherein FIG. 1 is a perspective exploded view of the baseless lamp and mounting fixture of the present invention;

FIG. 2 is a front elevational view in partial section;

FIG. 3 is a side elevational view; and

FIG. 4 is an enlarged view of one portion of the fixture shown in FIG. 3.

DESCRIPTION OF THE EMBODIMENTS

As may be seen in FIGS. 1 and 2, the lamp assembly 10 of the present invention includes an insulating mounting fixture 12 and baseless electric lamp assembly 22. The mounting fixture 12 is divided into three portions. The first portion is an elongated lower segment 14 which is connected to a central flange portion 16 which in turn is connected to an upper wall portion 18. The upper wall portion 18 surrounds the lower end of the bulbous portion 24 of lamp assembly 22 and includes ramp 16a for interengagement with a power receptacle. The elongated lower segment 14 of mounting fixture 12 surrounds flat press 26 of lamp assembly 22. Contained within mounting fixture 12 and extending above central flange portion 16 are electrically conductive terminal members 32. Terminal members 32 make electrical contact with power receptacles in automobiles by physical contact with tangs 32b.

Extending from press 26 of lamp assembly 22 are wire leads 30. Wire leads 30 pass through press 26 and engage filament 28. When electrical current passes through wire leads 30 and into filament 28, lamp 22 illuminates.

Wire leads 30 and connecting terminals 32 may be interconnected when press 26 of lamp assembly 22 is contained within elongated lower segment 14 of mounting fixture 12. This interengagement may be accomplished in any one of several different ways. Shown particularly in FIG. 4 is the frictional engagement of wire lead 30 with connector 32 by contacting lead 30 around the U-shaped end 31 of connector 32 against inside wall 34 and boss 33 of the elongated lower portion 14 of socket assembly 12. This capturing or wedging of lead wires 30 within mounting fixture 12 provides for both electrical connection and retention of lamp assembly 22 within socket 12. If desired, it is also possible to weld exposed lead wires 30 to connectors 32 through window 38 to further assure positive retention of lamp assembly 22 within socket 12 by both welded and mechanical connection. Such welding or soldering may be accomplished through window 38 in lower segment 14.

Socket assembly 12 may be made of a plastic material. It has been found that nylon or mineral filled nylon may be used, however, any suitable plastic having similar characteristics may also be used. The connectors 32 are ideally formed of brass, however, any metal or conductive material providing similar rigidity and electrical conductivity may be used without departing from the scope of the invention.

There is thereby provided by the baseless lamp and mounting fixture of the present invention a convenient inexpensive device and method for retaining a baseless electric lamp in a mounting fixture for mounting in a power receptacle on an automobile. The device and method of the present invention eliminates the problem of non-existent or weak connections between the lamp leads and the terminals in the mounting fixture.

While the present invention has been described in accordance with its preferred embodiment, it will be understood that the scope of the invention is only to be determined by the appended claims.

We claim:

1. In a mounting system for a baseless electrical lamp utilizing an insulator having a hollow lower portion around the press portion of said baseless electrical lamp through which upturned lead wires from the lamp pass, said lower portion further including an integral flange portion beneath a bulbuous portion of the said baseless electrical lamp and having provisions for electrical contact extending above flange portion, the improvement comprising:

employing an elongated integral electrical connector extending downwardly from the provisions for electrical contact between the insulator and the press portion of the baseless electrical lamp, said elongated electrical connector having a lower U-shaped portion for frictionally engaging the lead wires from the lamp against inner surfaces within the lower portion of the insulator, said inner surfaces including an outer wall of the hollow lower portion of the insulator and a boss formed on the inside of a bottom surface of the insulator.

2. The improvement as claimed in claim 1 further including a window formed within the lower portion of the insulator so that the electrical connector may be welded to the lead wire.

3. The improvement as defined in claim 2 wherein said weld is between points of frictional contact.

* * * * *